US009711861B2

(12) United States Patent
Kashino et al.

(10) Patent No.: US 9,711,861 B2
(45) Date of Patent: Jul. 18, 2017

(54) ANTENNA DEVICE

(71) Applicant: Panasonic Intellectual Property Management Co., Ltd., Osaka (JP)

(72) Inventors: Yuichi Kashino, Ishikawa (JP); Hiroyuki Uno, Ishikawa (JP); Maki Nakamura, Osaka (JP); Suguru Fujita, Tokyo (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 2 days.

(21) Appl. No.: 14/722,436

(22) Filed: May 27, 2015

(65) Prior Publication Data

US 2015/0349428 A1 Dec. 3, 2015

(30) Foreign Application Priority Data

Jun. 3, 2014 (JP) ..... 2014-114915

(51) Int. Cl.
*H01Q 13/10* (2006.01)

(52) U.S. Cl.
CPC ..... *H01Q 13/106* (2013.01)

(58) Field of Classification Search
None
See application file for complete search history.

(56) References Cited

U.S. PATENT DOCUMENTS 6,342,864 B1 * 1/2002 Muramoto ..... H01Q 13/106 343/700 MS
2005/0162328 A1 * 7/2005 Mori ..... H01Q 3/44 343/770
2006/0044200 A1 * 3/2006 Mori ..... H01Q 19/30 343/770

FOREIGN PATENT DOCUMENTS

JP 2002-359517 12/2002

* cited by examiner

*Primary Examiner* — Robert Karacsony
(74) *Attorney, Agent, or Firm* — Seed IP Law Group LLP

(57) ABSTRACT

An antenna device includes a dielectric substrate, a conductor plate that is placed on one surface of the dielectric substrate, that includes a first slot element, a second slot element, and one or more slits, and a ground conductor that is placed at a specified distance from the conductor plate in a first direction. A center of the first slot element is placed between a center of the second slot element and a center of each of slits, in a second direction.

4 Claims, 11 Drawing Sheets

ANTENNA DEVICE

BACKGROUND

1. Technical Field

The present disclosure relates to an antenna device.

2. Description of the Related Art

As a conventional antenna device, an antenna device for base station that includes a dielectric substrate and a parasitic element has been known. In the dielectric substrate, a grounding conductor plate provided with a slot is formed on one surface and a strip conductor is formed on the other surface. The parasitic element is provided so as to face the grounding conductor plate (see Japanese Unexamined Patent Application Publication No. 2002-359517, for instance).

FIG. 15 is a plan view illustrating a configuration of the parasitic element 400 in the antenna device for base station that is disclosed in Japanese Unexamined Patent Application Publication No. 2002-359517. Slits 401 are provided on periphery of the quadrangular parasitic element 400 in the antenna device for base station and wide-band characteristics for the antenna device for base station is thereby attained.

SUMMARY

In the antenna device for base station of Japanese Unexamined Patent Application Publication No. 2002-359517, an antenna has directivity in a direction of +Z axis of the parasitic element 400. In technology of Japanese Unexamined Patent Application Publication No. 2002-359517, it is difficult to maintain gain of the antenna of the antenna device for base station by tilting the directivity of the antenna to a desired direction (substrate horizontal direction, for instance).

One non-limiting and exemplary embodiment provides an antenna device in which directivity of an antenna can favorably be tilted so that gain of the antenna can be improved.

In one general aspect, the techniques disclosed here feature an antenna device including a dielectric substrate, a conductor plate that is placed on one surface of the dielectric substrate, that includes a first slot element, a second slot element, and one or more slits, and a ground conductor that is placed at a specified distance from the conductor plate in a first direction, a center of the first slot element is placed between a center of the second slot element and a center of each of slits, in a second direction.

According to the disclosure, the directivity of the antenna can favorably be tilted so that the gain of the antenna can be improved.

Additional benefits and advantages of the disclosed embodiments will become apparent from the specification and drawings. The benefits and/or advantages may be individually obtained by the various embodiments and features of the specification and drawings, which need not all be provided in order to obtain one or more of such benefits and/or advantages.

DETAILED DESCRIPTION

Hereinbelow, an embodiment of the disclosure will be described with reference to the drawings.

(Underlying Knowledge Forming Basis of the Present Disclosure)

Figure 16:
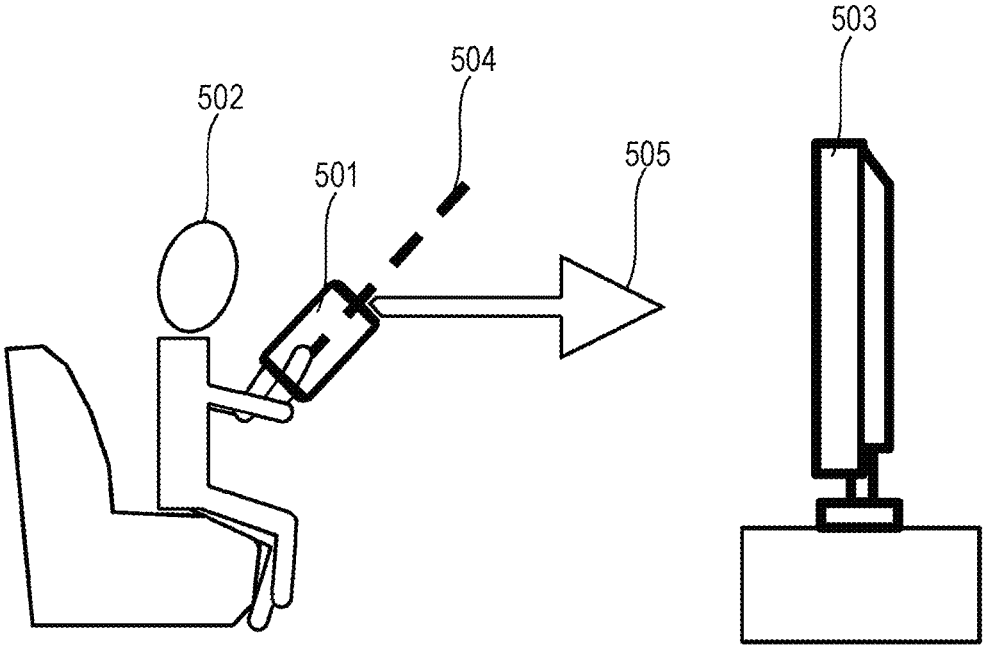
FIG. 16 is a schematic diagram illustrating an example of a use case that is assumed for an antenna device installed in a portable terminal.

A use case illustrated in FIG. 16 is assumed for an antenna device installed in a portable terminal, for instance. In FIG. 16, a user 502 holding a portable terminal 501 uses the portable terminal 501 to transmit control signals to a television device 503, for instance. Then convenience for the user is improved on condition that the portable terminal 501 has directivity in a direction 505 tilted (inclined) by a specified angle from a substrate surface direction 504 (direction parallel to substrate surfaces) in the portable terminal 501. There is a possibility, however, that a tilt of the directivity of the antenna device may cause a decrease in gain of the antenna device.

For the embodiment below, the antenna device in which the directivity of an antenna can favorably be tilted so that the gain of the antenna can be improved will be described.

EMBODIMENT

The antenna device of the embodiment is used for a radio communication circuit for high-frequency waves in millimeter band (60 GHz, for instance), for instance, and various electronic components (such as antenna and semiconductor chips) are mounted on the antenna device. The antenna device operates as a slot antenna with slits, for instance.

Figure 1:
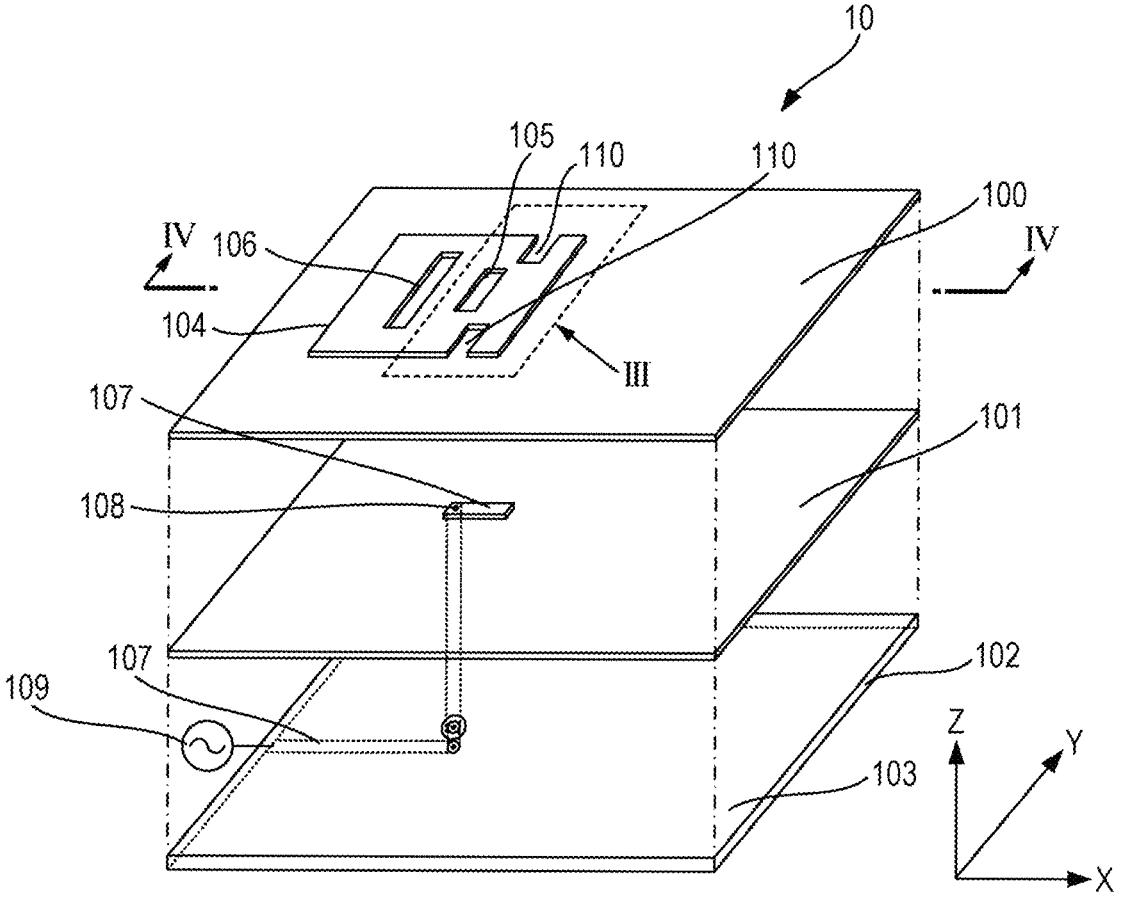
FIG. 1 is an exploded perspective view illustrating an example of a structure of an antenna device in an embodiment.
Figure 2A:
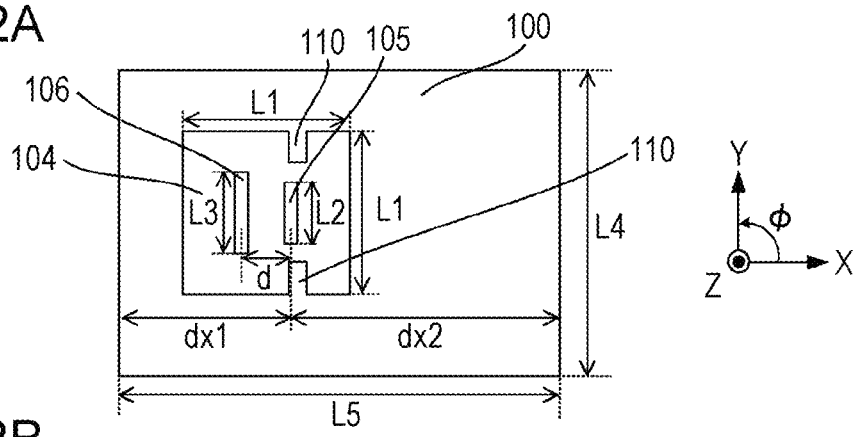
FIG. 2A is a plan view illustrating an example of a pattern configuration on a first dielectric substrate in a multilayer substrate in the embodiment.
Figure 2B:
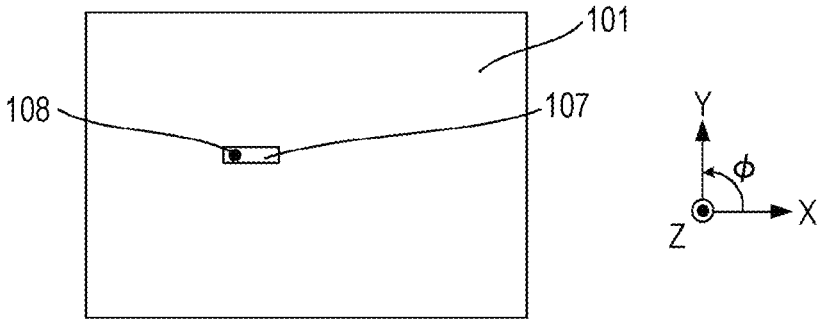
FIG. 2B is a plan view illustrating an example of a pattern configuration on a second dielectric substrate in the multilayer substrate in the embodiment.
Figure 2C:
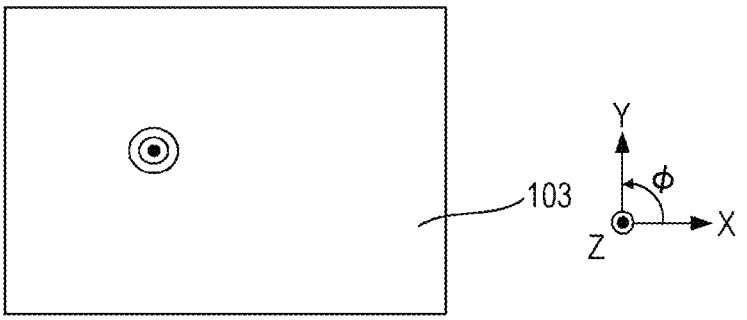
FIG. 2C is a plan view illustrating an example of a pattern configuration on a ground conductor in the multilayer substrate in the embodiment.
Figure 2D:
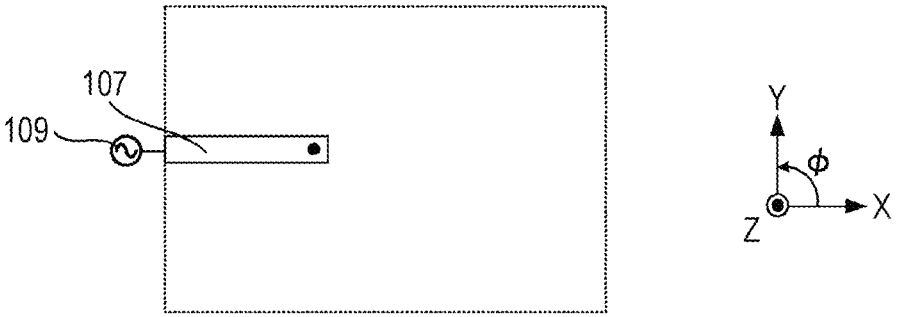
FIG. 2D is a plan view illustrating an example of a pattern configuration on a feeder in the multilayer substrate in the embodiment.
Figure 3:
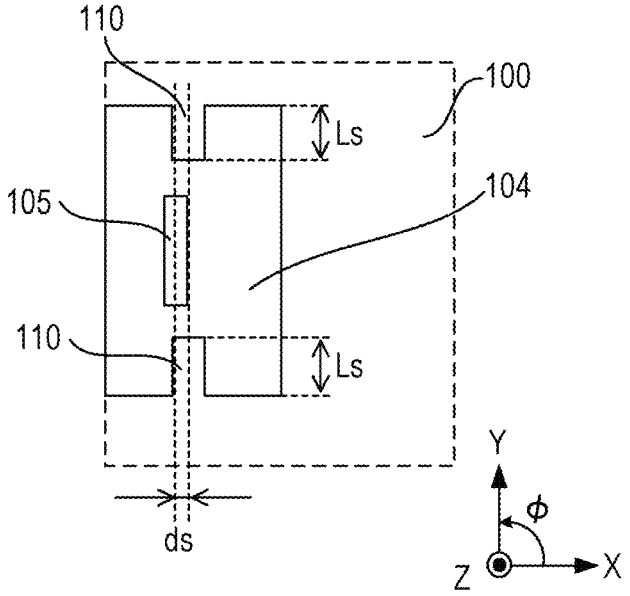
FIG. 3 is an enlarged view illustrating an example of an area III including slits in a pattern on the antenna device in the embodiment.
Figure 4:
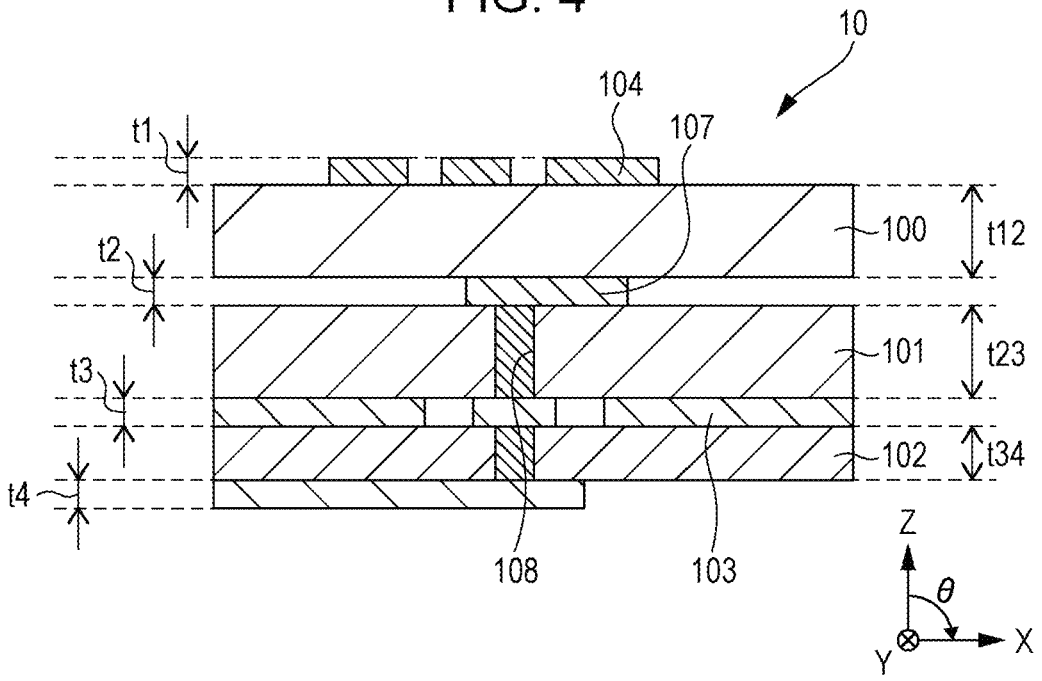
FIG. 4 is a sectional view, taken along line IV-IV, illustrating the example of the structure of the antenna device in the embodiment.

FIG. 1 is an exploded perspective view illustrating an example of a configuration of the antenna device 10 according to the embodiment. FIG. 2A is a plan view illustrating an example of a pattern configuration on a first dielectric substrate 100 in a multilayer substrate in the antenna device 10, FIG. 2B is a plan view illustrating an example of a pattern configuration on a second dielectric substrate 101 in the multilayer substrate in the antenna device 10, FIG. 2C is a plan view illustrating an example of a pattern configuration on a ground conductor 103 in the multilayer substrate in the antenna device 10, and FIG. 2D is a plan view illustrating an example of a pattern configuration on a feeder 107 in the multilayer substrate in the antenna device 10. FIG. 3 is an enlarged view illustrating an example of an area III including slits 110 in a pattern 104 on the antenna device 10. FIG. 4 is a sectional view, taken along line IV-IV, illustrating the example of the configuration of the antenna device 10 illustrated in FIG. 1. A state in which the substrates are assembled is illustrated in FIG. 4.

The antenna device 10 includes the first dielectric substrate 100, the second dielectric substrate 101, a third dielectric substrate 102, the ground conductor 103, the pattern 104, a radiating element 105, a reflector element 106, the feeder 107, and the slits 110. That is, the antenna device 10 includes the multilayer substrate. The pattern 104 has a substantially square shape in plan view, for instance, and is formed of metal conductor (such as copper foil).

The first dielectric substrate 100, the second dielectric substrate 101, and the third dielectric substrate 102 are substrates having a relative dielectric constant of Er (3.6, for instance). The first dielectric substrate 100, the second dielectric substrate 101, and the third dielectric substrate 102 are placed so as to be substantially parallel to one another.

In FIG. 1, the first dielectric substrate 100 has a thickness of t12 (0.02λ, for instance). The second dielectric substrate 101 has a thickness of t23 (0.03λ, for instance). The third dielectric substrate 102 has a thickness of t34 (0.02λ, for instance). A sign "λ" denotes a free space wavelength corresponding to a frequency that is used by the antenna device 10.

In the embodiment, one surface side (+Z side) of the first dielectric substrate 100 is referred to as a first layer (L1 layer) and the one surface side (+Z side) of the second dielectric substrate 101 is referred to as a second layer (L2 layer). The one surface side (+Z side) of the third dielectric substrate 102 is referred to as a third layer (L3 layer) and the other surface side (−Z side) of the third dielectric substrate 102 is referred to as a fourth layer (L4 layer).

In FIG. 1, a copper foil pattern formed in the L1 layer has a thickness of t1. A copper foil pattern formed in the L2 layer has a thickness of t2. A copper foil pattern formed in the L3 layer has a thickness of t3. A copper foil pattern formed in the L4 layer has a thickness of t4. The thicknesses t1 through t4 of the copper foil patterns are 0.004λ, for instance.

In the L1 layer, the pattern 104 that is formed of the copper foil pattern and that is substantially square, for instance, is placed on the one surface side (+Z side) of the first dielectric substrate 100. The radiating element 105 and the reflector element 106 that are formed by cutting of portions of the pattern 104 in shape of slots are provided on the pattern 104. The radiating element 105 is an example of the first slot element. The reflector element 106 is an example of the second slot element.

With respect to the X direction, the pattern 104 is placed on a side (−X side) opposite to a radiation direction from center of the first dielectric substrate 100, for instance. Radio waves radiated from the pattern 104 are guided into the first dielectric substrate 100 and are propagated through inside of the first dielectric substrate 100. The radiation direction (beam) of the radio waves is thereby inclined in the +X direction.

The radiating element 105 and the reflector element 106 are placed so as to be substantially parallel to each other in the L1 layer. The reflector element 106 is longer than the radiating element 105 in a longitudinal direction (Y direction in FIG. 1). The reflector element 106 is placed on the side (−X side in FIG. 1) opposite to a desired antenna radiation direction (direction of the directivity) from the radiating element 105. Thus the slot antenna is formed of the conductor pattern on the dielectric substrate.

The radiating element 105 operates as a radiator for radiating the radio waves. Therefore, a slot length (length in the longitudinal direction of the radiating element 105 in FIG. 1) L2 is set to be approximately ½λg. Therein, "λg" denotes a wavelength that corresponds to the frequency used by the antenna device 10 and that is set in consideration of a wavelength shortening effect in the substrate.

The reflector element 106 operates as a reflector. Therefore, a distance d between the radiating element 105 and the reflector element 106 is set to be approximately ¼λg. Setting of the distance d at approximately ¼λg makes it possible to tilt the directivity of the antenna from a horizontal direction (XY direction) or a vertical direction (Z direction) for the substrate. A slot length (length in the longitudinal direction of the reflector element 106 in FIG. 1) L3 of the reflector element 106 is set so as to be longer than the slot length L2 of the radiating element 105 and so as to be shorter than a length L1 of one side of the substantially square pattern 104 that is parallel to the radiating element 105.

Length from the radiating element 105 to an end side of the first dielectric substrate 100 that faces the reflector element 106 (on −X side) is dx1 (1.15 λg, for instance). Length from the radiating element 105 to an end side of the first dielectric substrate 100 that exists in the radiation direction (on +X side) is dx2 (2.89 λg, for instance).

The pattern 104 includes the slits 110 that are formed by cutting of portions of the pattern 104, in end parts (an example of the second end parts) of the pattern 104 with respect to the Y direction. The slits 110 are formed in either or both of the end parts of the pattern 104 with respect to the Y direction. Though the slits 110 that are formed at the same position with respect to the X direction in both of the end parts with respect to the Y direction so as to face each other are illustrated as the examples in FIGS. 1, 2A, and 3, the slits may be formed at different positions with respect to the X direction so as not to face each other.

The slits 110 are formed between the radiating element 105 and a +X direction end part (an example of the first end part) of the pattern 104 with respect to the X direction. Providing that a distance (interval) between center of the radiating element 105 and center of the slits 110 in the X direction is designated by ds, setting of $ds \geq 0\lambda$ is made. For instance, setting of $0\lambda \leq ds \leq 0.08\lambda$ is made. That is, the distance ds designates the position (slit position) of the slits 110 relative to the radiating element 105 in the X direction. A −X direction end part of the pattern 104 is an example of a third end part.

The slits 110 are formed so as not to overlap with the radiating element 105 with respect to the Y direction. Providing that a length (slit length) of the slits 110 along the Y direction is designated by Ls, setting of $0.016\lambda \leq Ls \leq 0.05\lambda$, is made, for instance.

In the L2 layer, the feeder 107 is provided on the one surface side (+Z side) of the second dielectric substrate 101. The feeder 107 is placed in a position substantially orthogonal to the radiating element 105 in plan view of XY plane so as to be electromagnetically coupled to the radiating element 105.

The feeder 107 extends to the L4 layer via a through hole 108 formed from the L2 layer to the L3 layer and is connected to a feeder unit 109. The feeder unit 109 is provided on an external substrate (such as motherboard) not illustrated, for instance.

As described above, the radiating element 105 is a feed element and the reflector element 106 is a parasitic element. The feeder 107 does not have to supply electricity to a plurality of radiating elements and has only to have a length that enables supply of electricity to the radiating element 105. Therefore, length of the feeder 107 in the L2 layer can be shortened and thus signal loss caused by the feeder 107 can be reduced.

In the L3 layer, the ground conductor 103 is placed on the one surface side (+Z side) of the third dielectric substrate 102. The ground conductor 103 is placed so as to be substantially parallel to the pattern 104 placed on the first dielectric substrate 100.

In the L4 layer, electronic components may be mounted on the other surface side (−Z side) of the third dielectric substrate 102. On condition that electronic components (such as semiconductor chips) are mounted in the L4 layer, the ground conductor 103 is placed between the electronic components and the radiating element 105 or the reflector element 106 as the antenna. Thus electrical interference between the electronic component side and the antenna side can be prevented and reliability of the antenna device 10 is thereby improved.

The other surface side (−Z side) of the third dielectric substrate 102 is an example of the other surface of the second dielectric substrate 101 on which the electronic components are mounted.

Subsequently, gains of the antenna device that are obtained in presence or absence of the slits 110 will be described.

Figure 5:
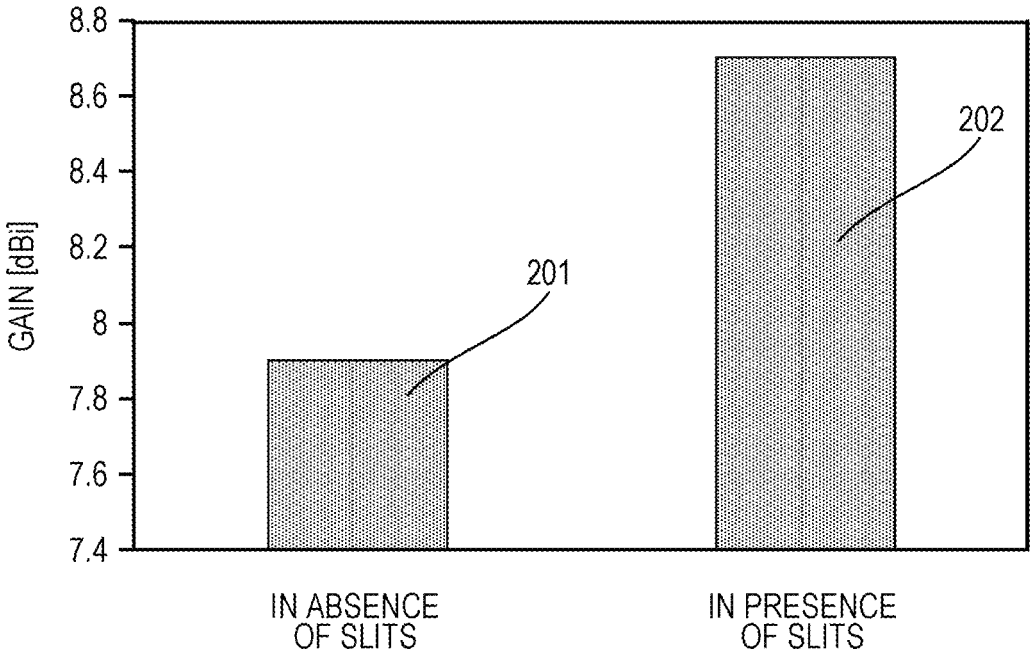
FIG. 5 is a schematic diagram illustrating an example of a gain of the antenna device in absence of the slits and an example of a gain of the antenna device in presence of the slits in the embodiment.

FIG. 5 is a schematic diagram illustrating an example of the gain of the antenna device that does not include the slits 110 (in absence of the slits) and an example of the gain of the antenna device 10 that includes the slits 110 (in presence of the slits). Conditions other than the presence or absence of the slits are the same.

In FIG. 5, the gain 201 in absence of the slits is on the order of 7.9 dBi and the gain 202 in presence of the slits is on the order of 8.7 dBi. With reference to FIG. 5, it can be understood that the gain can be made higher in presence of the slits than in absence of the slits.

Subsequently, examples of analysis of antenna radiation patterns of the antenna device 10 will be described.

Figure 6A:
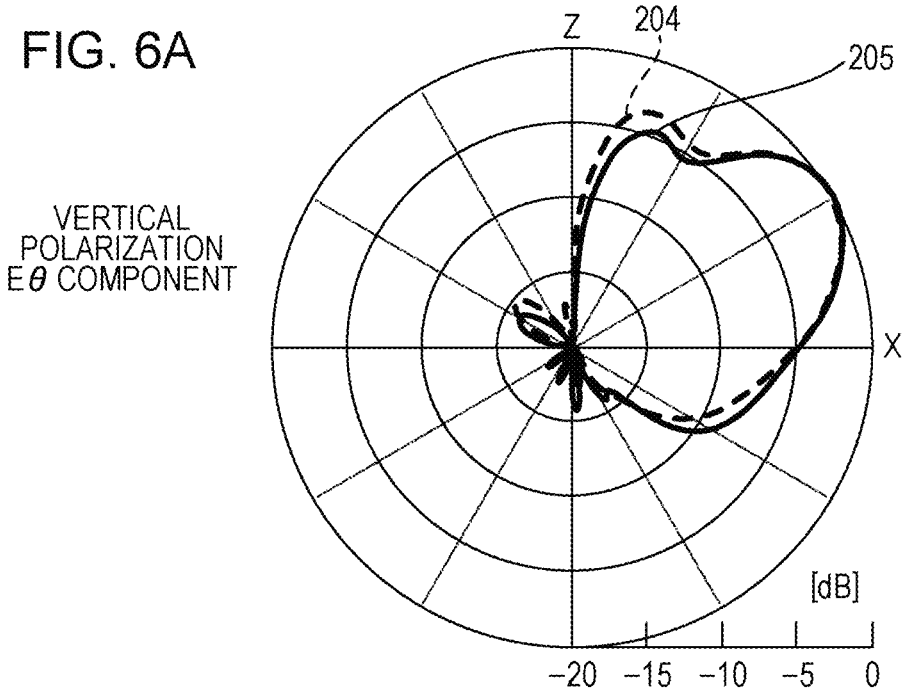
FIG. 6A is a schematic diagram illustrating an example of analysis results (vertical (XZ) plane directivity) on antenna radiation patterns in presence of the slits and in absence of the slits in the embodiment.
Figure 6B:
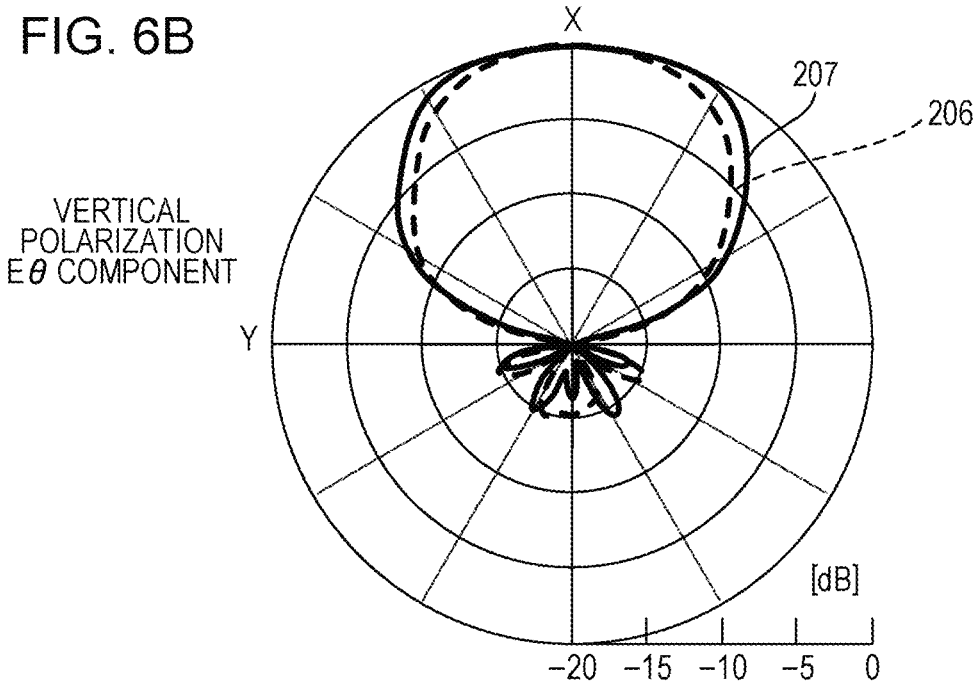
FIG. 6B is a schematic diagram illustrating an example of analysis results (conical plane directivity ($\theta$=58 degrees) on the antenna radiation patterns in presence of the slits and in absence of the slits in the embodiment.

FIGS. 6A and 6B are schematic diagrams each illustrating an example of analysis result on the antenna radiation pattern analyzed by finite integration method for the antenna device 10 that is designed with dimensions described above as the examples. As the radiation patterns of FIGS. 6A and 6B, radiation patterns of polarization (Eθ component) in the direction vertical to the substrate that conforms to main polarization are illustrated. FIGS. 6A and 6B are illustrated with standardization based on peak value (0 dB at maximum). It is assumed in FIGS. 6A and 6B that conditions other than the presence or absence of the slits are the same. Conditions of the slits in FIG. 6B are $ds=0.04\lambda$ and $Ls=0.39\lambda$, for instance.

FIG. 6A illustrates the radiation patterns 204 and 205 indicating directivity on a substrate vertical plane (XZ plane). The radiation pattern 204 represents a radiation pattern in presence of the slits. The radiation pattern 205 represents a radiation pattern in absence of the slits.

It is observed from the radiation patterns 204 and 205 in FIG. 6A that elevation angle (tilt angle) θ is approximately 58 degrees, where θ of the +Z direction is represented by 0 degrees, and is tilted from the +Z direction toward a substrate horizontal direction (XY direction).

Figure 7:
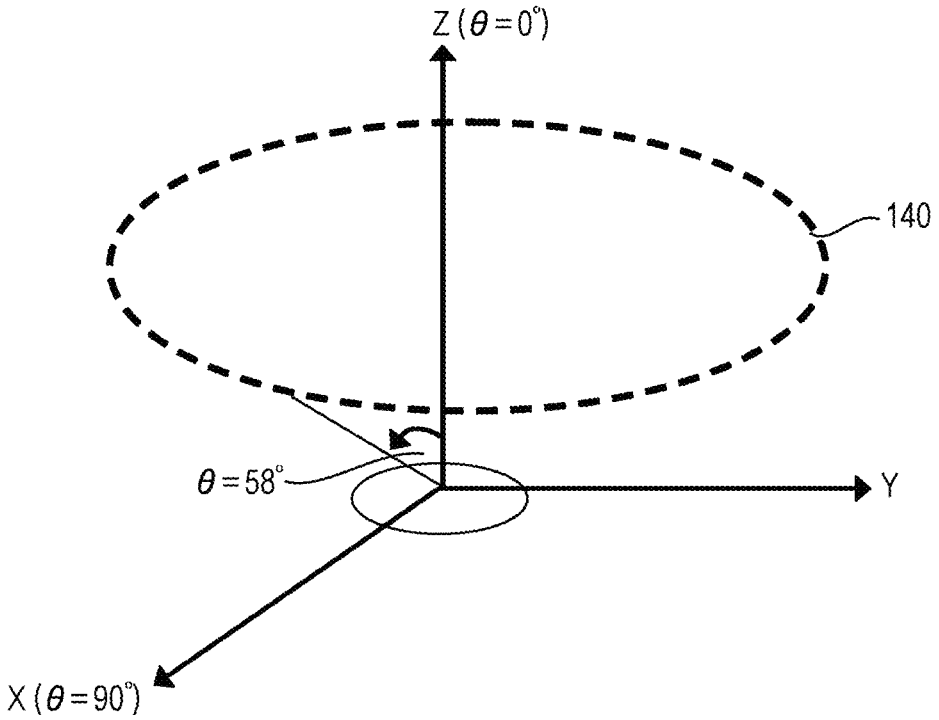
FIG. 7 is a schematic diagram for illustrating the conical plane directivity in the embodiment.

FIG. 6B illustrates the radiation patterns 206 and 207 indicating the directivity on a conical plane (XY plane). The radiation pattern 206 represents a radiation pattern in presence of the slits. The radiation pattern 207 represents a radiation pattern in absence of the slits. As illustrated in FIG. 7, the conical plane directivity indicates directivity of a beam tilt direction (θ=58 degrees) on a plane 140 parallel to the substrate horizontal direction (XY direction).

It is observed from the radiation patterns 206 and 207 in FIG. 6B that radio waves radiated from the radiating element 105 chiefly have +X direction component with respect to the substrate horizontal direction (XY direction). It is also observed that the radiation pattern 206 has narrower spread in the Y direction and more intense directivity in the X direction than the radiation pattern 207 has and indicates more focused beam.

Subsequently, current distribution in the antenna device 10 will be described.

Figure 8A:
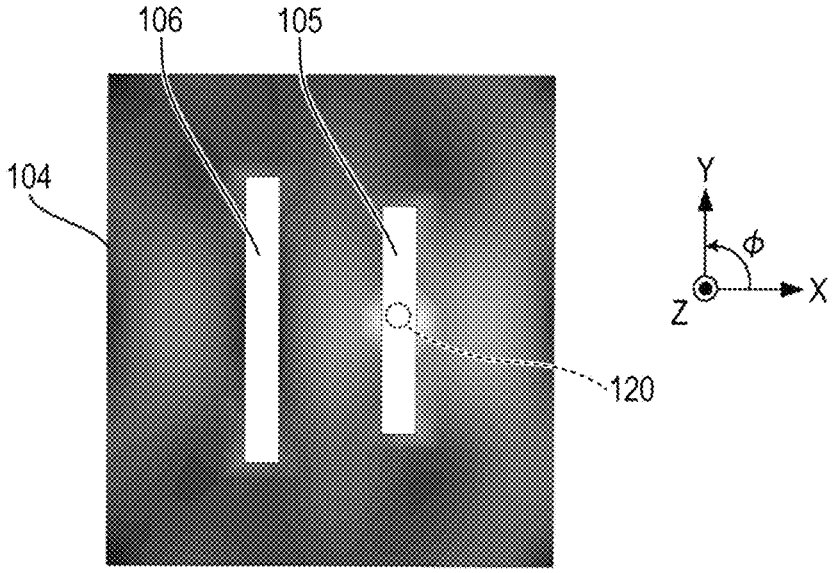
FIG. 8A is a schematic diagram illustrating an example of current distribution in the antenna device in absence of the slits in the embodiment.
Figure 8B:
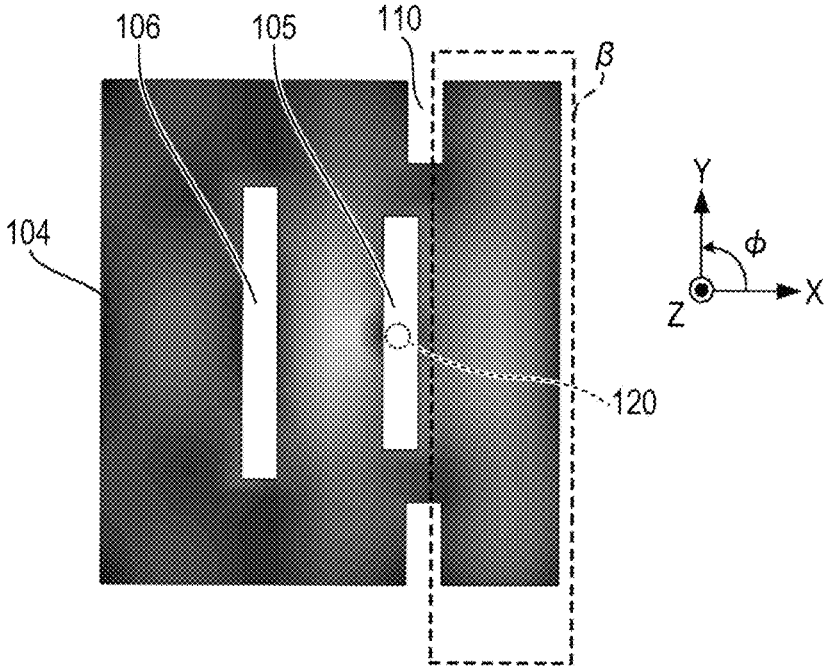
FIG. 8B is a schematic diagram illustrating an example of current distribution in the antenna device in presence of the slits in the embodiment.

FIGS. 8A and 8B are schematic diagrams each illustrating an example of current distribution in the antenna device 10. FIG. 8A illustrates an example of current distribution characteristics in absence of the slits. FIG. 8B illustrates an example of current distribution characteristics in presence of the slits. It is assumed in FIGS. 8A and 8B that conditions other than the presence or absence of the slits are the same. Conditions of the slits in FIG. 8B are $ds=0.04\lambda$ and $Ls=0.39\lambda$, for instance.

In FIGS. 8A and 8B, the antenna device 10 indicates the current distribution on occasion when electricity is supplied from a feeding point 120. White regions therein indicate that current values are relatively high and black regions indicate that the current values are relatively low. The feeding point 120 corresponds to a specified point included in the feeder 107.

In the antenna device 10 of FIG. 8A in absence of the slits, radio waves radiated from the radiating element, the reflector element, and the pattern are synthesized and a radiation pattern is thereby formed.

In the antenna device 10 of FIG. 8B in presence of the slits, it is observed that current values in a broad area in a pattern region β along ±Y direction are higher than the current values in the antenna device 10 of FIG. 8A. The antenna device 10 of FIG. 8B in presence of the slits is larger in effective opening space than the antenna device 10 of FIG. 8A in absence of the slits and thus provides more focused beam on the XY plane, because of the higher current values in the broad area along ±Y direction. As a result, a high gain can be obtained by the antenna device 10 of FIG. 8B in presence of the slits.

Subsequently, an example of change in antenna performance with change in the distance ds will be described.

Figure 9:
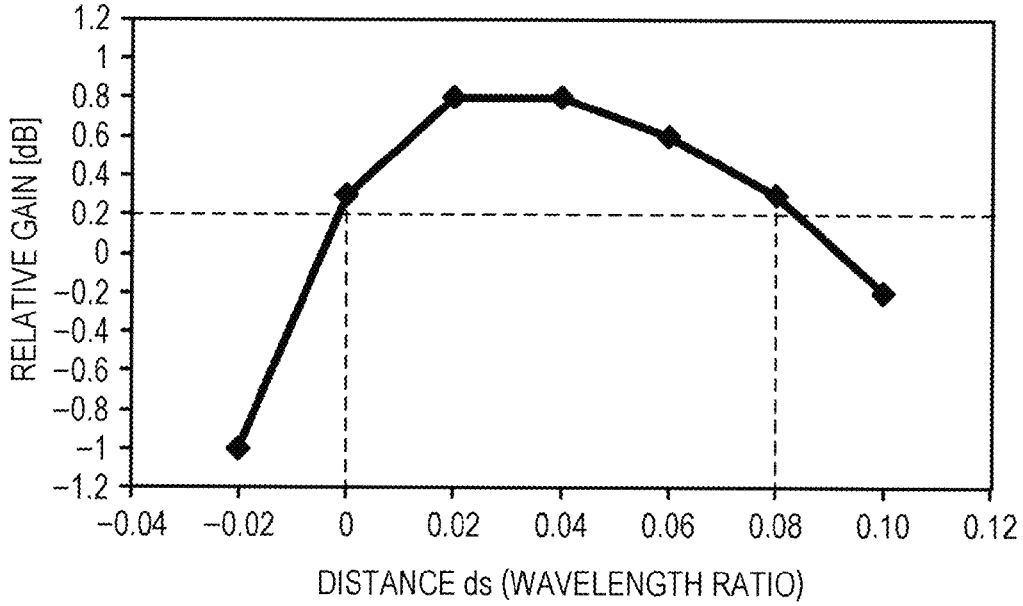
FIG. 9 is a schematic diagram illustrating an example of change in relative gain with change in positions of the slits in the embodiment.
Figure 10:
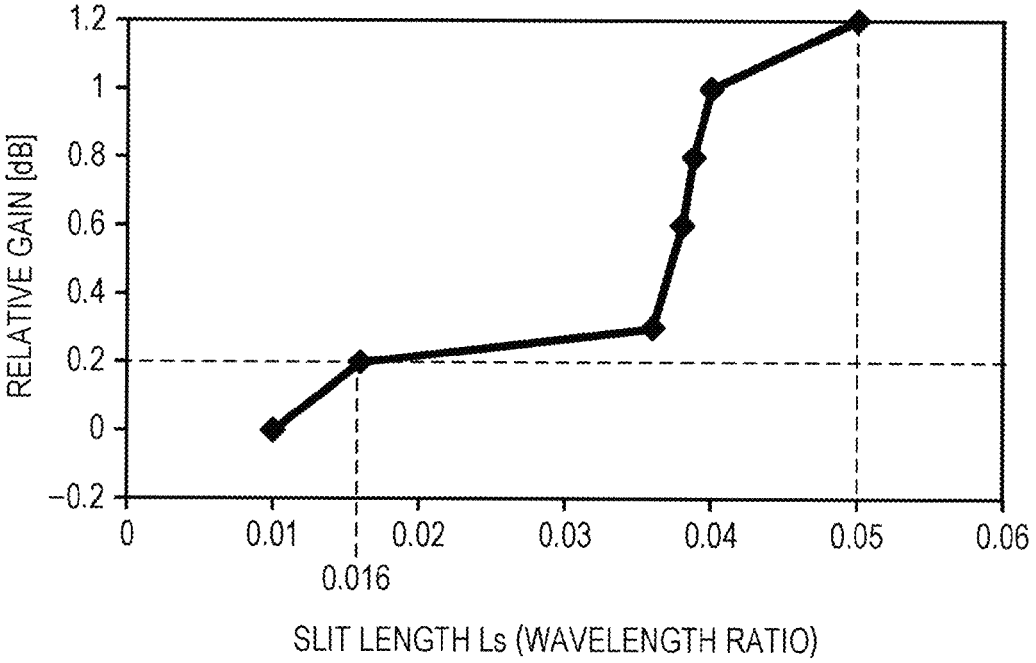
FIG. 10 is a schematic diagram illustrating an example of change in the relative gain with change in slit length in the embodiment.

FIG. 9 is a schematic diagram illustrating an example of change in relative gain with the change in the distance ds between the center of the radiating element 105 and the center of the slits 110. FIG. 10 is a schematic diagram illustrating an example of change in the relative gain with change in the slit length Ls. In FIG. 9, the distance ds is expressed by wavelength ratio (λ). In FIG. 10, the slit length Ls is expressed by wavelength ratio (λ). In FIGS. 9 and 10, the relative gain in absence of the slits, as a reference of the relative gain, is 0 dB.

With reference to FIG. 9, it can be understood that the distance ds in a range from about −0.005λ to about 0.09λ inclusive (−X direction from the center of the radiating element 105 provides minus values) leads to the relative gain equal to or larger than 0 dB and results in higher antenna gain than the gain in absence of the slits. Therefore, the distance ds is set in a range from 0λ to 0.08λ, inclusive, for instance. In this configuration, the relative gain is equal to or larger than 0.2 dB and thus the antenna gain can favorably be improved.

With reference to FIG. 10, it can be understood that the slit length Ls in a range from about 0.01λ to about 0.05λ inclusive leads to the relative gain equal to or larger than 0 dB and results in higher antenna gain than the gain in absence of the slits. On condition that the slit length Ls is larger than about 0.05λ in the antenna device 10, there is a possibility that the radiating element 105 may overlap with the slits 110. Therefore, the slit length Ls is set in a range from 0.016λ to 0.05λ inclusive, for instance. In this configuration, the relative gain is equal to or larger than 0.2 dB and thus the antenna gain can favorably be improved.

Subsequently, an example of change in the antenna performance with change in the length L1 will be described.

Figure 11:
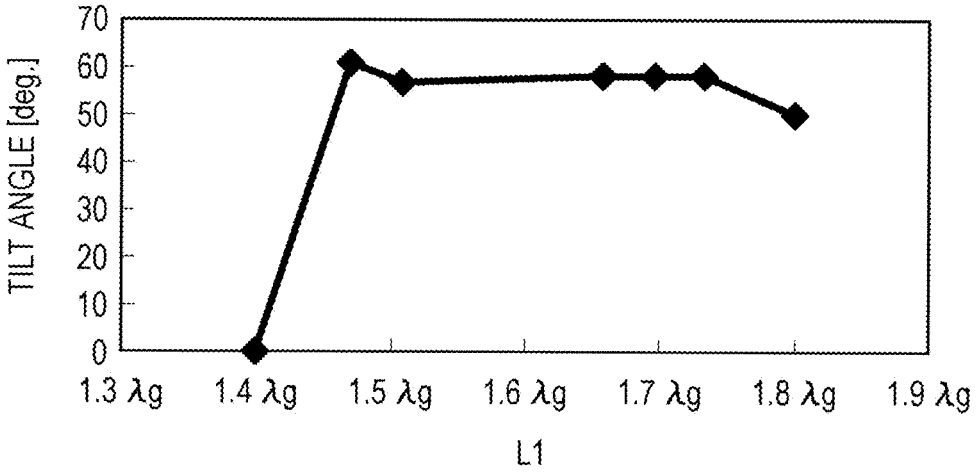
FIG. 11 is a schematic diagram illustrating an example of relation between length L1 and tilt angle $\theta$ in the embodiment.
Figure 12:
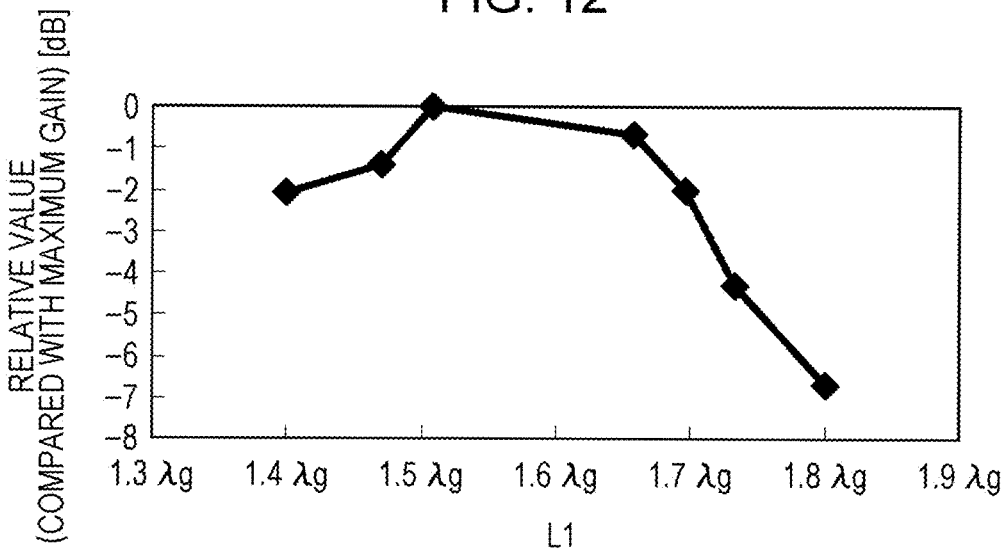
FIG. 12 is a schematic diagram illustrating an example of relation between the length L1 and the gain (standardized by maximum value) in the embodiment.

FIG. 11 is a schematic diagram illustrating an example of change in the tilt angle with the change in the length L1 of one side of the pattern 104. FIG. 12 is a schematic diagram illustrating an example of change in the gain with the change in the length L1 of one side of the pattern 104. Vertical axis in FIG. 12 for which the gain to be measured is standardized by being divided by maximum gain indicates relative value of the gain.

With reference to FIG. 11, it is observed that the length L1 in a range from 1.47 λg to 1.8 λg inclusive makes the tilt angle have a comparatively large specified value (50 degrees to 60 degrees, for instance). With reference to FIG. 12, it is observed that the gain to be measured is maximized under a condition that L1 is about 1.51λg.

Accordingly, the tilt angle θ can be adjusted by adjustment in the length L1 of one side of the pattern 104. For instance, the desired tilt angle θ is set to be 50 to 60 degrees on assumption that the antenna device 10 is mounted on the portable terminal 501 illustrated in FIG. 16. In the portable terminal 501, the desired tilt angle can be obtained with high accuracy by setting of the length L1 of one side of the pattern 104 in the range from 1.47 λg to 1.8 λg inclusive.

Subsequently, an example of change in the antenna performance with change in the length dx2 of the antenna device 10 will be described.

Figure 13:
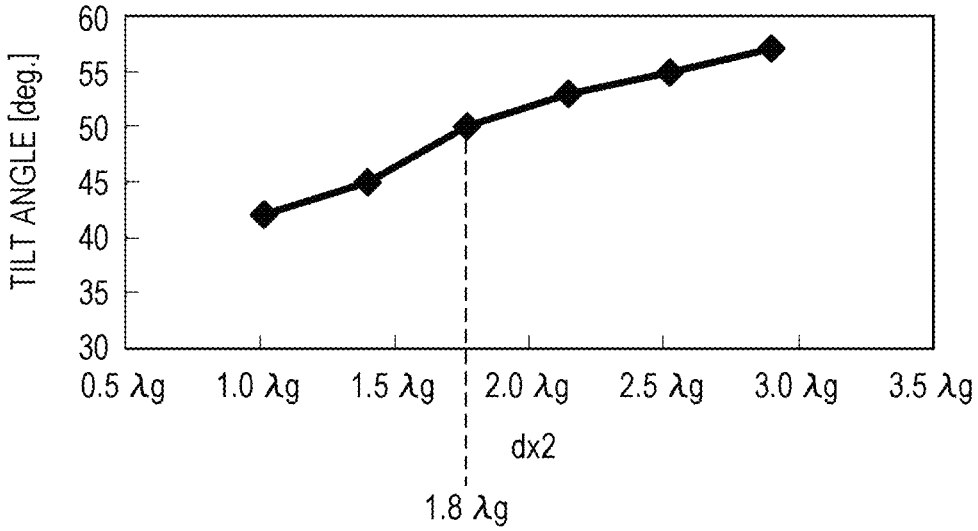
FIG. 13 is a schematic diagram illustrating an example of relation between length dx2 and the tilt angle $\theta$ in the embodiment.

FIG. 13 is a schematic diagram illustrating an example of relation between the length dx2 from the radiating element 105 to the end side of the first dielectric substrate 100 that exists in the radiation direction (on +X side) and the tilt angle θ.

With reference to FIG. 13, it is observed that increase in the length dx2 causes increase in the tilt angle. On condition that the length dx2 becomes smaller than 1.8 λg, the tilt angle decreases to 50 degrees or smaller.

Thus the tilt angle θ can be adjusted by adjustment in the length dx2. For instance, the desired tilt angle θ is set to be 50 to 60 degrees on assumption that the antenna device 10 is mounted on the portable terminal 501 illustrated in FIG. 16. In this configuration, the desired tilt angle can be obtained with high accuracy by setting of the length dx2 at 1.8 λg or larger.

Subsequently, an example of change in the antenna performance with change in the length dx1 of the antenna device 10 will be described.

Figure 14:
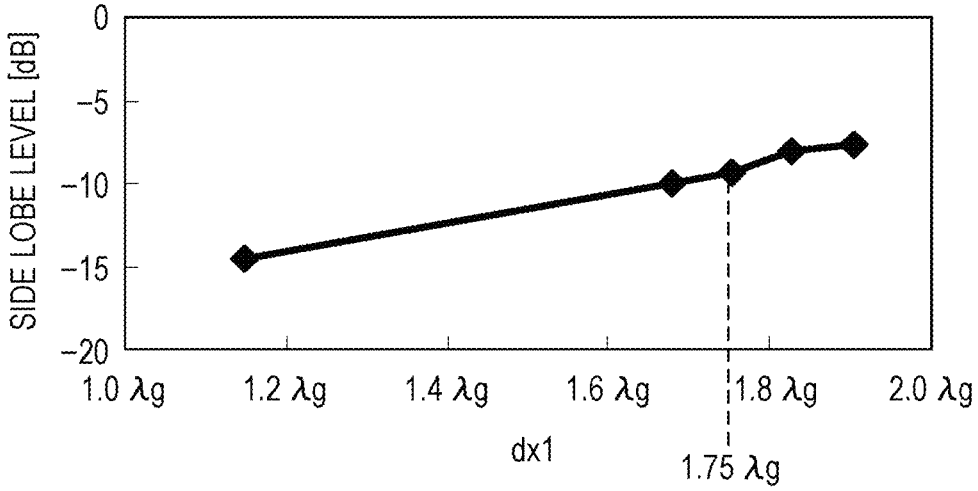
FIG. 14 is a schematic diagram illustrating an example of relation between length dx1 and side lobe level in the embodiment.
Figure 15:
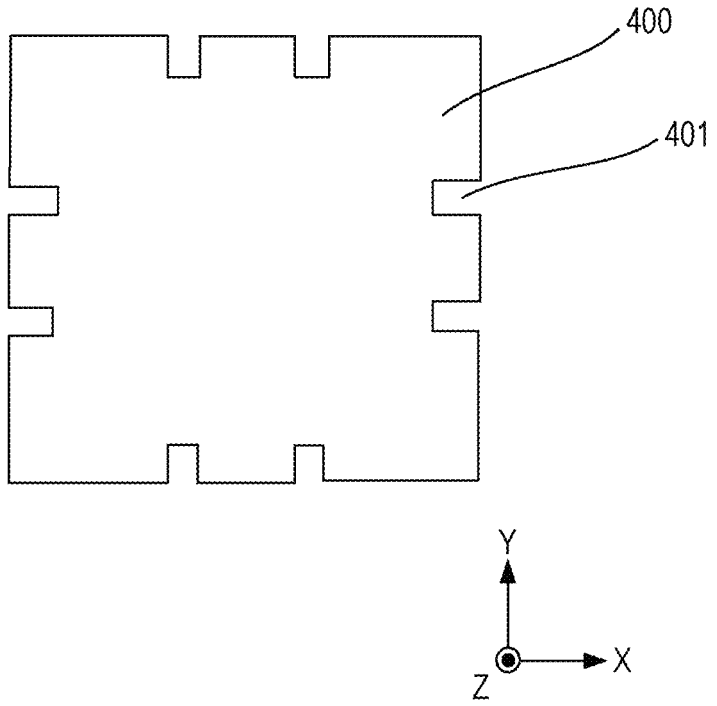
FIG. 15 is a plan view illustrating a configuration of a parasitic element in an antenna device for base station that is disclosed in Japanese Unexamined Patent Application Publication No. 2002-359517.

FIG. 14 is a schematic diagram illustrating an example of relation between the length dx1 from the radiating element 105 to the end side of the first dielectric substrate 100 on the reflector element 106 side (−X side) and side lobe level. Herein, a main lobe represents a radiation component of a radio wave in a direction having the most intense directivity. Side lobes represent radiation components of a radio wave in directions having the second or the subsequent most intense directivity.

In FIG. 14, difference between main lobe level (radiation level of the main lobe) and the side lobes (radiation levels of the side lobes) is expressed in decibels (dB).

With reference to FIG. 14, it is observed that the side lobe level becomes larger as the length dx1 becomes larger. On condition that the length dx1 is 1.75 λg or smaller, the side lobe level becomes about −10 dB. The gain in the direction of the main lobe increases as the side lobe level in FIG. 14 becomes smaller.

Thus the side lobe level can be adjusted by adjustment in the length dx1.

In the antenna device 10, the pattern 104 is provided between the radiating element 105 and the +X direction end part with respect to the X direction of the pattern 104 and thus the currents can extensively be distributed along the radiation direction (on +X side) in the pattern 104. Thus the directivity of the antenna can favorably be tilted so that the gain of the antenna resulting from the tilt can be improved. Provision of the slits 110 enhances paths in the pattern 104 through which the currents flow and thereby enables wideband characteristics.

In the antenna device 10, the provision of the slits 110 in the end parts of the pattern 104 with respect to the Y direction facilitates retention of high-frequency currents between the radiating element 105, the slits 110, and the +X direction end part (see the pattern region (3 in FIG. 8B), for instance, and enables further improvement in the directivity and the gain of the antenna.

With the slits 110 provided in both the end parts of the pattern 104 with respect to the Y direction so as to face each other, the antenna device 10 excels in symmetry in the Y direction and improves accuracy in radio wave radiation in the +X direction, for instance. In the antenna device 10, the two slits 110 focus the beam and the conical plane directivity and intensify the directivity of the antenna.

In the antenna device 10, the beam tilt (the tilt angle of 50 to 60 degrees, for instance) that is nearer to the substrate horizontal direction (XY direction) than to the substrate vertical direction (Z direction) can be attained, for instance.

The antenna device 10 supplies electricity by electromagnetic coupling to the radiating element 105, for instance, and thus allows the feeder 107 to be shortened. Accordingly, the antenna device 10 reduces transmission loss in the feeder 107 and thus improves the antenna performance. Furthermore, influence of length of conductor line is prone to be greater as communication is performed with higher frequency. Accordingly, high-frequency communication with little loss can be attained by application of the antenna device 10 to millimeter-wave communication.

In the antenna device 10, the ground conductor 103 that functions as a reflecting plate can be provided in the multilayer substrate in order to prevent radiation of radio waves in the −Z direction, for instance. Accordingly, there is no need to provide a reflecting plate as a separate member in addition to the dielectric substrates and thus the configuration of the antenna device 10 can be simplified.

In the antenna device 10, electronic components (such as chip components and/or integrated circuits (ICs)) are mounted in the L4 layer, for instance, so that the ground conductor 103 that functions as a ground is placed between the antenna and the electronic components. Thus the antenna device 10 is capable of reducing the electrical interference between the antenna and the electronic components. Therefore, the antenna device 10 can easily be modularized with maintenance of satisfactory electrical characteristics thereof.

The antenna device 10 may be mounted on a receiver side instead of a transmitter side.

The disclosure is not limited to the configuration of the embodiment and can be applied to any configuration as long as the configuration achieves functions disclosed in the claims or functions the configuration of the embodiment has.

Though the embodiment in which the radiating element 105 and the reflector element 106 are formed in the pattern 104 has been described, for instance, a director may further be formed therein. The director is an example of a third slot element.

Like the radiating element 105 and the reflector element 106, the director is formed by cutting of the pattern 104 into a slot shape. The director is placed substantially in parallel with the radiating element 105, on a side (+X side in FIG. 1) opposite to the reflector element 106 with respect to the radiating element 105, and at a specified distance (approximately ¼ λg, for instance) from the radiating element 105. Electrical length of the director is set so as to be shorter than electrical length of the radiating element 105. A plurality of reflector elements 106 and a plurality of directors may be formed.

The directivity in the substrate horizontal direction (XY plane) can further be improved by provision of the director.

(Overview of One Aspect of the Disclosure)

A first antenna device according to the disclosure includes a dielectric substrate, a conductor plate that is placed on one surface of the dielectric substrate, that includes a first slot element, a second slot element, and one or more slits, and a ground conductor that is placed at a specified distance from the conductor plate in a first direction. A center of the first slot element is placed between a center of the second slot element and a center of each of slits, in a second direction.

A second antenna device according to the disclosure is the first antenna device in which the first slot element is supplied with electricity from a feeder, and has an electrical length of an approximately half wavelength for a frequency that is used, the second slot element has an electrical length longer than the first slot element has, the center of the second slot is placed at a distance of an approximately quarter wavelength in electrical length from the center of the first slot element in the second direction, and a longitudinal direction of the first slot and a longitudinal direction of the second slot in a longitudinal direction are placed substantially in parallel in a third direction.

A third antenna device according to the disclosure is the first antenna device in which the one or more slits are placed on at least either of two end parts of the conductor plate, the two end parts are placed substantially in parallel in a third direction.

A fourth antenna device according to the disclosure is the first antenna device in which the slits are placed to face each other on both of the two end parts of the conductor plate, the two end parts are placed substantially in parallel in a third direction.

A fifth antenna device according to the disclosure is the first antenna device in which center of the each of slits is placed at a distance equal to or smaller than 0.08 wavelength in electrical length for the frequency that is used by the antenna device, from center of the first slot element in the second direction.

A sixth antenna device according to the disclosure is the first antenna device in which a length of the each of slits in the first direction along the first end part is equal to or longer than 0.016 wavelength and equal to or shorter than 0.05 wavelength in electrical length for the frequency that is used by the antenna device.

Though various embodiments have been described above with reference to the drawings, it is needless to say that the disclosure is not limited to such examples. It is apparent that those skilled in the art can conceive various alterations or modifications within the scope described in the claims and it is to be understood that such alterations and modifications shall fall under the technical scope of the disclosure as a matter of course. Components of the embodiments may arbitrarily be combined unless departing from the purport of the disclosure.

The disclosure is effective for antenna devices and the like in which directivity of an antenna can favorably be tilted so that gain of the antenna can be improved.

What is claimed is:

1. An antenna device comprising:

a dielectric substrate;

a conductor plate that is placed on one surface of the dielectric substrate, that includes a first slot element, a second slot element, and at least two slits, and that is not connected to a ground, and a ground conductor that is placed at a specified distance from the conductor plate in a first direction which is perpendicular to the surface of the dielectric substrate, that is connected to the ground, wherein:

a center of the first slot element is placed between a center of the second slot element and a center of each of the at least two slits, in a second direction, which is perpendicular to the first direction; and a longitudinal direction of the first slot element, a longitudinal direction of the second slot element and longitudinal directions of the at least two slits are parallel in a third direction which is perpendicular to the first and second directions, and each of the at least two slits extends longitudinally starting from a respective edge of two edges of the conductive plate toward a center of the conductive plate in the third direction, the two edges being opposite to each other and parallel to the second direction.

2. The antenna device according to claim 1, wherein:

the first slot element is supplied with electricity from a feeder, and has an electrical length of an approximately half wavelength for a frequency that is used, the second slot element has an electrical length longer than the first slot element has, and the center of the second slot is placed at a distance of an approximately quarter wavelength in electrical length from the center of the first slot element in the second direction.

3. An antenna device comprising:

a dielectric substrate;

a conductor plate that is placed on one surface of the dielectric substrate, that includes a first slot element, a second slot element, and at least two slits, and that is not connected to a ground, and a ground conductor that is placed at a specified distance from the conductor plate in a first direction which is perpendicular to the surface of the dielectric substrate, that is connected to the ground, wherein a center of the first slot element is placed between a center of the second slot element and a center of each of the at least two slits, in a second direction which is perpendicular to the first direction, and a center of each of the at least two slits is placed at a distance equal to or smaller than 0.08 wavelength in electrical length for the frequency that is used by the antenna device, from center of the first slot element in the second direction.

4. An antenna device comprising:

a dielectric substrate;

a conductor plate that is placed on one surface of the dielectric substrate, that includes a first slot element, a second slot element, and at least two slits, and that is not connected to a ground, and a ground conductor that is placed at a specified distance from the conductor plate in a first direction which is perpendicular to the surface of the dielectric substrate, that is connected to the ground, wherein:

a center of the first slot element is placed between a center of the second slot element and a center of each of the at least two slits, in a second direction which is perpendicular to the first direction, and a length of each of the at least two slits in a third direction is equal to or longer than 0.016 wavelength and equal to or shorter than 0.05 wavelength in electrical length for the frequency that is used by the antenna device.

* * * * *